US007635013B2

(12) United States Patent
Ballinger

(10) Patent No.: US 7,635,013 B2
(45) Date of Patent: Dec. 22, 2009

(54) CAP ASSEMBLY AND METHOD THEREFOR

(75) Inventor: Darren L. Ballinger, Las Vegas, NV (US)

(73) Assignee: Tari Brandon, Las Vegas, NV (US), part interest ( * ) Notice: Subject to any disclaimer, the term of this patent is extended or adjusted under 35 U.S.C. 154(b) by 13 days.

(21) Appl. No.: 11/495,316

(22) Filed: Jul. 31, 2006

(65) Prior Publication Data

US 2008/0023103 A1 Jan. 31, 2008

(51) Int. Cl.
*B65B 39/00* (2006.01)

(52) U.S. Cl. ..... 141/338; 141/331; 141/337

(58) Field of Classification Search ..... 141/331–345; 222/461

See application file for complete search history.

(56) References Cited

U.S. PATENT DOCUMENTS

| | | | | | |
|---|---|---|---|---|---|
| 1,256,961 | A | | 2/1918 | Welsh | |
| 1,420,039 | A | | 6/1922 | Horstkotte | |
| 1,510,631 | A | * | 10/1924 | Nutry | 141/338 |
| 1,538,171 | A | | 5/1925 | Dailey | |
| 1,740,418 | A | * | 12/1929 | Donnelly | 141/337 |
| 4,557,378 | A | * | 12/1985 | Klebold | 206/223 |
| 5,033,521 | A | * | 7/1991 | Martin | 141/337 |
| 5,158,123 | A | | 10/1992 | Senko | |
| 5,188,157 | A | | 2/1993 | Lee | |
| 5,445,196 | A | | 8/1995 | Tyree, Jr. | |
| D403,642 | S | * | 1/1999 | Acord | D12/197 |
| 5,894,872 | A | | 4/1999 | Gale | |
| 6,223,793 | B1 | | 5/2001 | Donoughe | |
| 6,397,907 | B1 | * | 6/2002 | Heintz | 141/338 |
| 6,568,440 | B1 | | 5/2003 | Engelbrecht | |
| 6,830,085 | B1 | * | 12/2004 | Majewski | 141/338 |
| 6,837,283 | B1 | | 1/2005 | Wegner | |
| 6,935,389 | B1 | * | 8/2005 | Rinaldi | 141/337 |
| 7,014,074 | B1 | * | 3/2006 | Rinaldi | 222/461 |
| 7,264,027 | B2 | * | 9/2007 | Rosenbaum | 141/338 |

* cited by examiner

*Primary Examiner*—Timothy L Maust
(74) *Attorney, Agent, or Firm*—Veronica-Adele R. Cao; Craig Weiss; Weiss & Moy, P.C.

(57) ABSTRACT

A cap assembly and method therefore is disclosed. The cap assembly preferably has a funnel coupled thereto. Preferably, the funnel is stored within the cap assembly so that it will always be available for use. Further preferably, the user could avoid getting any of the liquid on his/her hands because the funnel would be capable of being placed into position and stored without the user ever having to touch it.

5 Claims, 5 Drawing Sheets

CAP ASSEMBLY AND METHOD THEREFOR

FIELD OF THE INVENTION

This invention relates generally to liquid containers and pertains in particular to an improved liquid container cap assembly.

BACKGROUND OF THE INVENTION

When filling a liquid container, spills often occur. One situation where this may prove to be messy is during engine maintenance. There are several liquids that must be added to an engine, such as oil, wiper fluid, clutch fluid, radiator water, etc. Currently, some use funnels to help avoid spillage. However, these funnels are separate instruments that have the potential of being misplaced or lost. Also, in order to use it, an individual must either take the time to locate and retrieve the funnel or the individual must keep it on his/her person. Furthermore, in order to use funnels for all of the types of liquid and to avoid mixing those liquids, a user must either use several funnels, or must wash the single funnel before using a different liquid. After use, the funnels must also be cleaned and stored away.

Therefore, a need existed for a cap assembly that has a funnel coupled thereto. Preferably, the funnel would be stored within the cap assembly so that it would always be available for use. Further preferably, the user could avoid getting any of the liquid on his/her hands because the funnel would be capable of being placed into position and stored without the user ever having to touch it.

SUMMARY OF THE INVENTION

An object of the present invention is to provide a cap assembly that has a funnel coupled thereto.

Another object of the present invention is to provide a cap assembly wherein the funnel would always be available for use.

Another object of the present invention is to provide a cap assembly wherein the funnel may be placed into position and stored without the user ever having to touch it.

BRIEF DESCRIPTION OF THE PREFERRED EMBODIMENTS

In accordance with an embodiment of the present invention, a cap assembly is disclosed. The cap assembly comprises a base dimensioned to be coupled to an opening of a liquid container, the base having a bottom portion and an annular side wall coupled to the bottom portion of the base, a lid having a top portion and an annular side wall coupled to the top portion, a telescoping funnel, a bottom portion of the telescoping funnel coupled to an inner surface of the bottom portion of the base, at least one slot defined by a top portion of the telescoping funnel, and at least one protrusion coupled to an inner surface of the annular side wall of the lid, the at least one protrusion dimensioned to engage the at least one slot so that the lid is detachably coupled to the top portion of the telescoping funnel.

In accordance with an embodiment of the present invention, a cap assembly is disclosed. The cap assembly comprises a base dimensioned to be coupled to an opening of a liquid container, the base having a bottom portion and an annular side wall coupled to the bottom portion, a lid having a top portion and an annular side wall coupled to the top portion, threading coupled to the annular side wall of the base, threading coupled to an inner surface of the annular side wall of the lid and dimensioned to removably mate with the threading coupled to the annular side wall of the base, a tapered telescoping funnel comprising a series of slidably coupled concentric rings, each successive ring increasing in diameter, wherein a top ring of the telescoping funnel is rotatably coupled to a preceding ring and wherein a bottom ring of the telescoping funnel is coupled to an inner surface of the bottom portion of the base, four slots defined by the top ring of the telescoping funnel, each slot having a wide end, a tapered middle portion, and a narrow end, and four protrusions coupled to the inner surface of the annular side wall of the lid, each protrusion dimensioned to enter the wide end of one of the four slots when the top is placed onto the top ring of the telescoping funnel and to slide along the tapered middle portion by twisting the lid until the protrusion is gripped by the narrow end.

In accordance with an embodiment of the present invention, a method of adding liquid to a liquid container of an engine is disclosed. The method comprises the steps of providing a base dimensioned to be coupled to an opening of a liquid container, the base having a bottom portion and an annular side wall coupled to the bottom portion, a lid having a top portion and an annular side wall coupled to the top portion, threading coupled to annular side wall of the base, threading coupled to an inner surface of the annular side wall of the lid and dimensioned to removably mate with the threading coupled to the annular side wall of the base, a telescoping funnel, a bottom portion of the telescoping funnel coupled to an inner surface of the bottom portion of the base, at least one slot defined by a top portion of the telescoping funnel, and at least one protrusion coupled to an inner surface of the annular side wall of the top, the at least one protrusion dimensioned to engage the at least one slot so that the lid being detachably coupled to the telescoping funnel, twisting the lid in a first direction to disengage the threading of the inner surface of the annular side wall of the lid from the threading of the annular side wall of the base, pulling upwardly on the lid to extend the telescoping funnel, twisting the lid in a second direction, the second direction being opposite from the first direction, to disengage the at least one protrusion from the at least one slot, and pouring liquid into the top portion of the telescoping funnel.

The foregoing and other objects, features, and advantages of the invention will be apparent from the following, more particular, description of the preferred embodiments of the invention, as illustrated in the accompanying drawings.

DETAILED DESCRIPTION OF THE PREFERRED EMBODIMENTS

Figure 1:
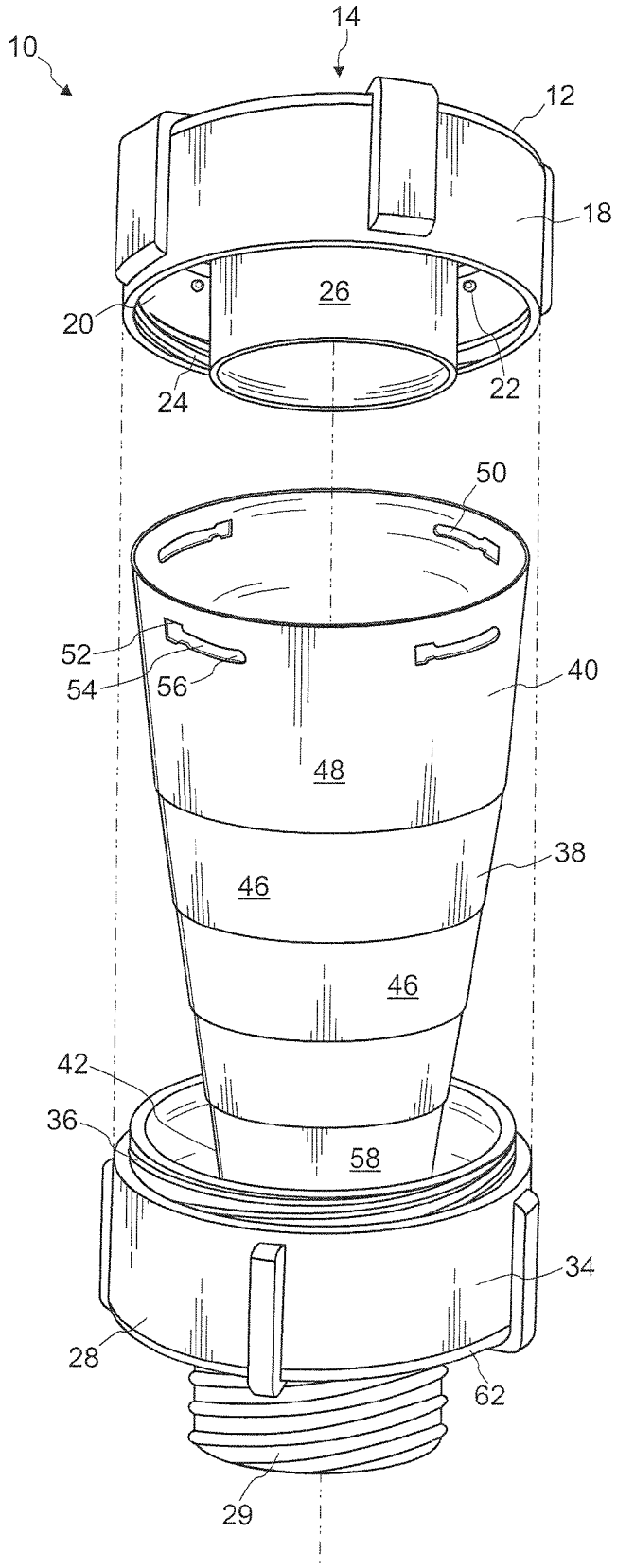
FIG. 1 is a partially exploded perspective view of a cap assembly of the present invention.

The novel features believed characteristic of the invention are set forth in the appended claims. The invention will best be understood by reference to the following detailed description of illustrated embodiments when read in conjunction with the accompanying drawings, wherein like reference numerals and symbols represent like elements.

FIGS. 1-9 together disclose a cap assembly, hereinafter cap assembly 10, for a liquid container. The cap assembly 10 comprises a lid 12, a base 28, and a telescoping funnel 38 coupled to the base 28.

Figure 2:
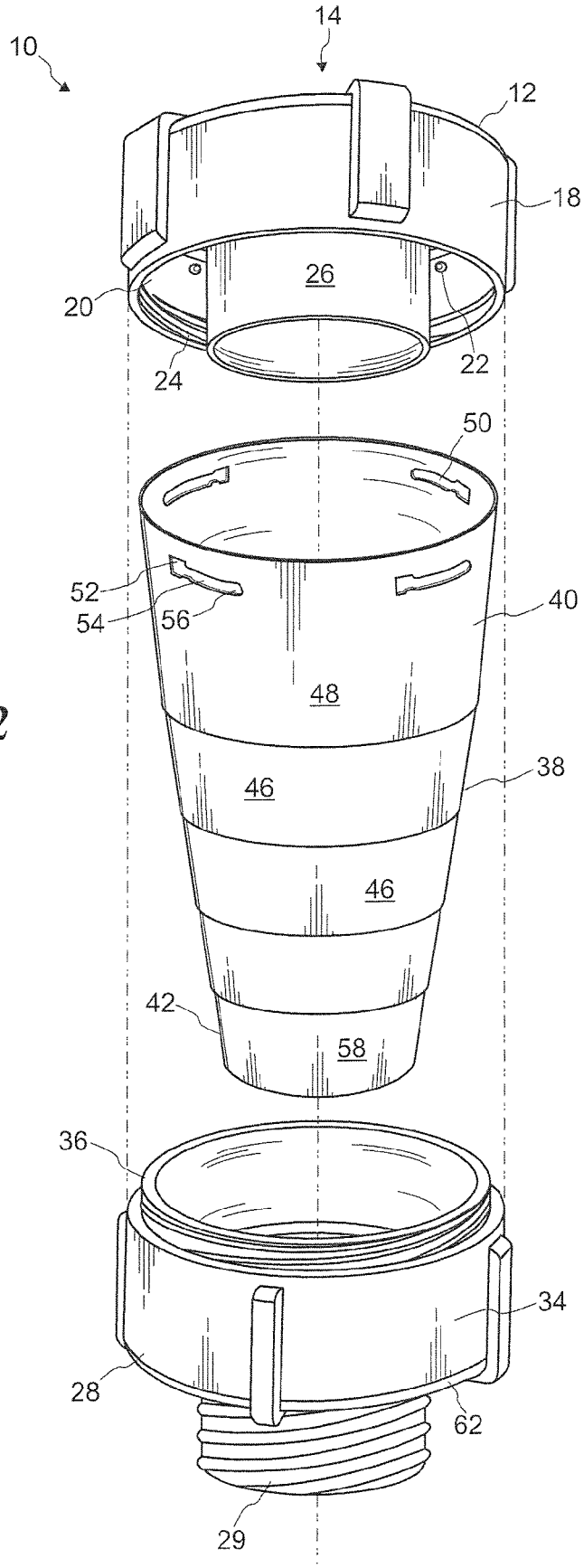
FIG. 2 is an exploded perspective view of the cap assembly of FIG. 1.
Figure 3:
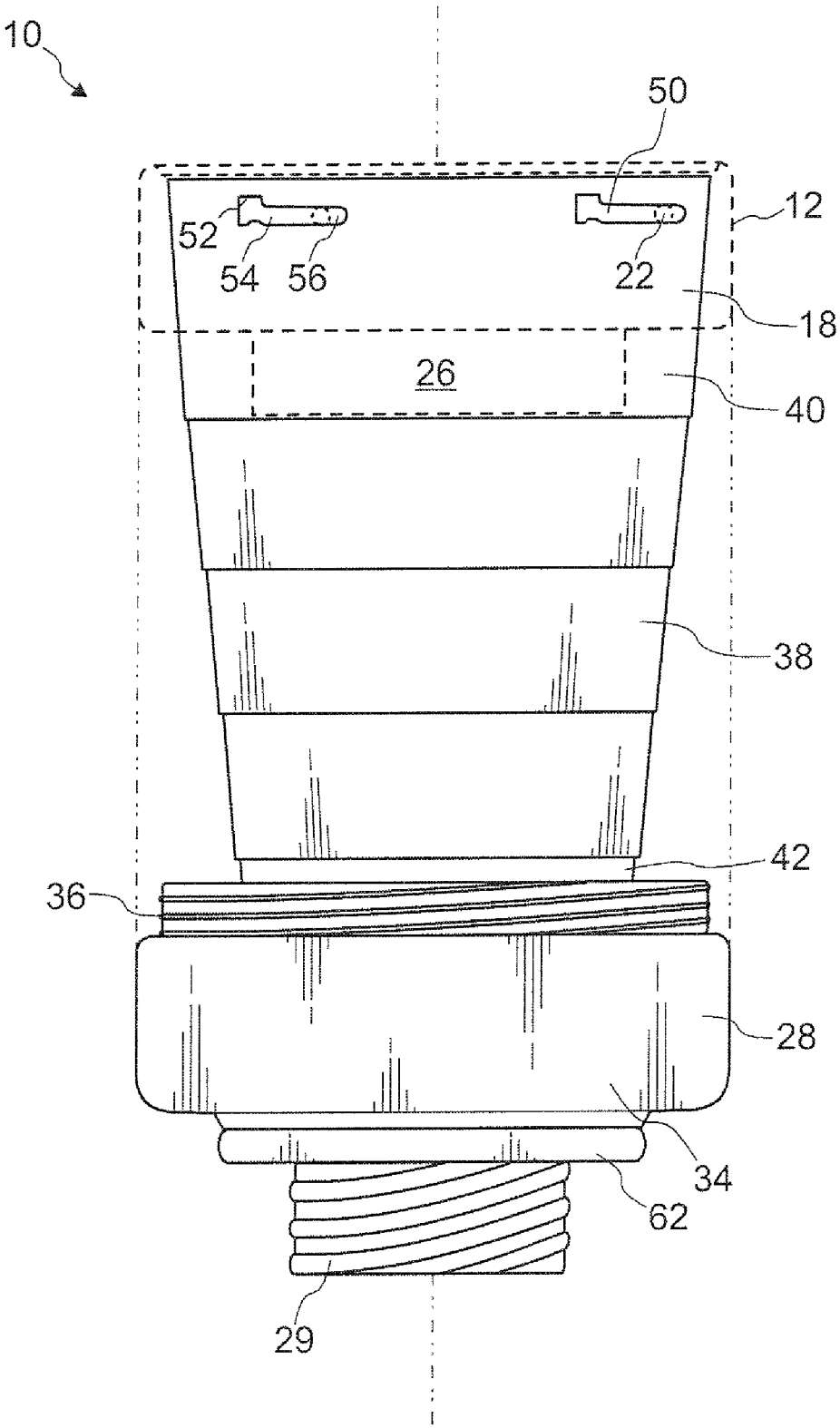
FIG. 3 is a side view of the cap assembly of FIG. 1 with the lid of the cap assembly shown in phantom lines.

Referring to FIGS. 1-3, the cap assembly 10 is shown in an open position. The base 28 is shown as having a bottom portion 30 defining an aperture 35 that would lead to the liquid container (not shown) and having an annular side wall 34 coupled to the bottom portion 30. The annular side wall 34 of the base 28 is shown as having threading 36. The base 28 also has an attachment end 29 coupled to an opposite side of the bottom portion 30 of the base 28 for coupling the base 28 to the liquid container. The attachment end 29 is shown as being threaded in order to be screwed onto the opening of a liquid container, however, it should be clearly understood that further substantial benefit may be derived from the base 28 being coupled to the liquid container by alternative means or from the base 28 being integral to the liquid container.

The lid 12 is shown as having a top portion 14 and an annular side wall 18 coupled to the top portion 14 of the lid 12. The lid 12 is also shown as having threading 24 coupled to an inner surface 18 of the annular side wall 18 of the lid 12 dimensioned to removably mate with the threading 36 coupled to the annular side wall 34 of the base 28. The lid 12 is also shown as having several protrusions 22 coupled to an inner surface 20 of the annular side wall 18 of the lid 12. While the lid 12 is shown as having four protrusions 22 (shown in FIG. 9), is should be clearly understood that substantial benefit may be derived from any number of protrusions 22. Preferably, these protrusions 22 are located above the threading 24 on the inner surface 20 of the annular side wall 18 of the lid 12. The lid 12 is also shown as having a center protrusion 26 coupled to and extending downwardly from an inner surface 16 of the top portion 14 of the lid 12.

A telescoping funnel 38 is also shown with a bottom portion 42 of the telescoping funnel 38 coupled to an inner surface 32 of the bottom portion 30 of the base 28. It should be clearly understood that further substantial benefit may also be derived from the bottom portion 42 of the telescoping funnel 38 being integral to the inner surface 32 of the bottom portion 30 of the base 28. The telescoping funnel 38 is also shown as having a top portion 40 defining several slots 50. While it is shown that the top portion 40 of the telescoping funnel 38 defines four slots 50 (see FIGS. 1-2), it should be clearly understood that substantial benefit may be derived from any number of slots 50. Each slot 50 is shown as having a wide end 52, a middle portion 54, and a narrow end 56. Preferably, the wide end 52 of the slot 50 is larger than the protrusion 22 and dimensioned to receive the protrusion 22. It is also preferred that the middle portion 54 be substantially tapered and that the narrow end 56 be dimensioned to tightly grip the protrusion 22. While this is preferred, it should be clearly understood that substantial benefit may be derived from a slot 50 that is uniform in width and from an alternative means of coupling the lid 12 to the top portion 40 of the telescoping funnel 38.

The telescoping funnel 38 is shown as being tapered, wherein the top portion 40 of the telescoping funnel 38 has a greater diameter than the bottom portion 42 of the telescoping funnel 38. The telescoping funnel 38 is shown as comprising a series of slidably coupled concentric rings 46, each successive ring 46 increasing in diameter. The slidably coupled concentric rings 46 that allow the telescoping funnel 38 to extend and to collapse. Preferably, a top ring 48 of the telescoping funnel 38 is rotatably coupled to a preceding ring 46 and a bottom ring 58 of the telescoping funnel 38 is coupled to an inner surface 32 of the bottom portion 30 of the base 28. By having the top ring 48 rotatably coupled to a preceding ring 46, the protrusions 22 remain gripped by the slots 50 while the lid 12 is being twisted. Preferably, twisting the lid 12 in one direction will disengage the lid 12 from the base 28 and twisting the lid 12 in an opposite direction after extending the telescoping funnel 38 will disengage the protrusions 22 from the slots 50 so that the lid 12 may be removed and liquid may be added to (or removed from) the liquid container. It should be clearly understood, however, that further substantial benefit may be derived from the protrusions 22 being disengaged from the slots 50 by twisting the lid 12 in the same direction as it was twisted when disengaging the lid 12 from the base 28.

Figure 4:
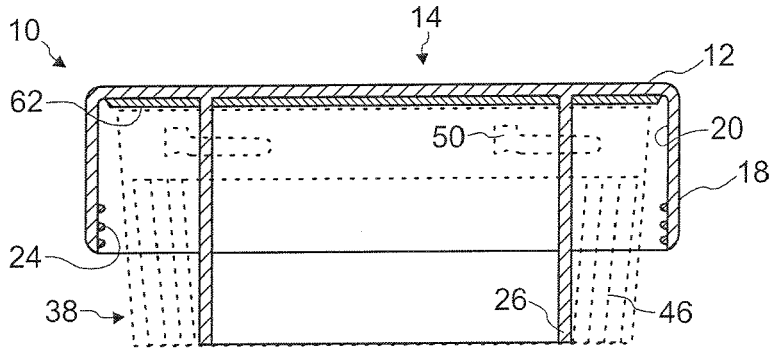
FIG. 4 is a cross-sectional side view of the lid and telescoping funnel (shown in phantom lines) of the cap assembly of FIG. 1 when the cap assembly is in a closed position.
Figure 5:
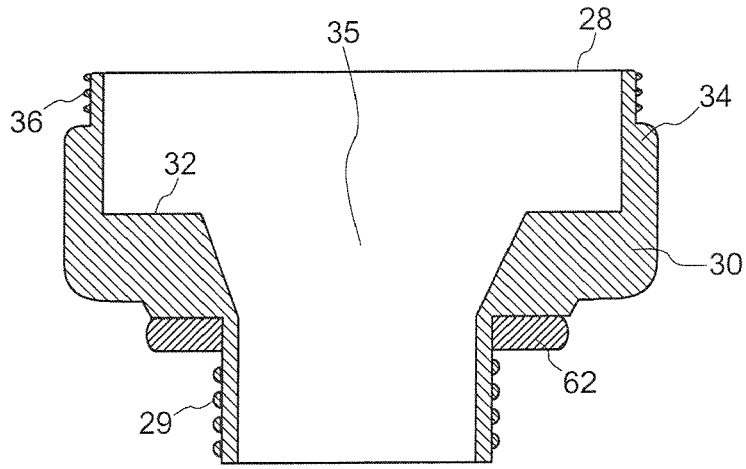
FIG. 5 is a side interior view of the base of the cap assembly of FIG. 1.

FIG. 4 shows the lid 12 and the telescoping funnel 38 in a collapsed position. FIG. 5 shows the base 28.

Figure 6:
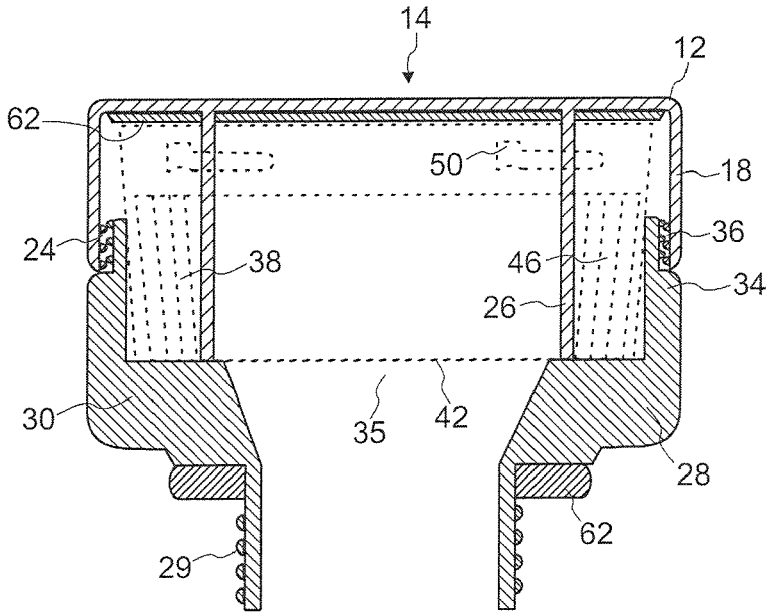
FIG. 6 is a cross-sectional side view of the lid, the telescoping funnel (shown in phantom lines), and the base of the cap assembly of FIG. 1 when the cap assembly is in a closed position.
Figure 7:
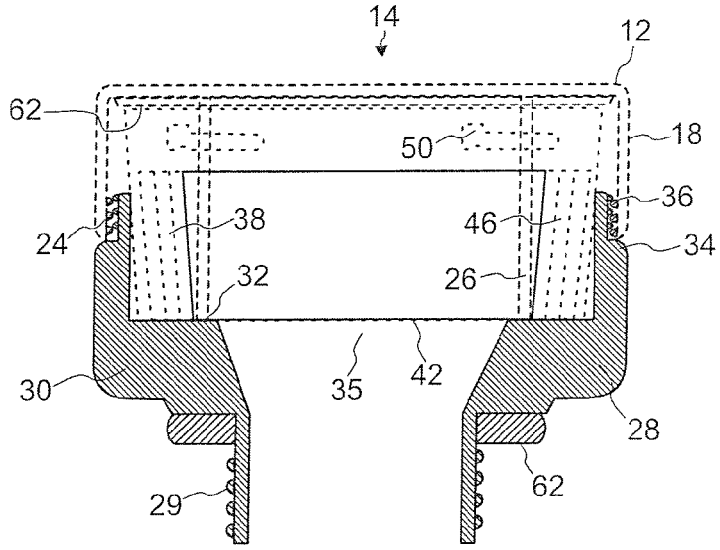
FIG. 7 is a side view of the lid (shown in phantom lines), the telescoping funnel (also shown in phantom lines), and the base of the cap assembly of FIG. 1 when the cap assembly is in a closed position. A bottom portion of the telescoping funnel is shown coupled to an inner surface of a bottom portion of the base.
Figure 8:
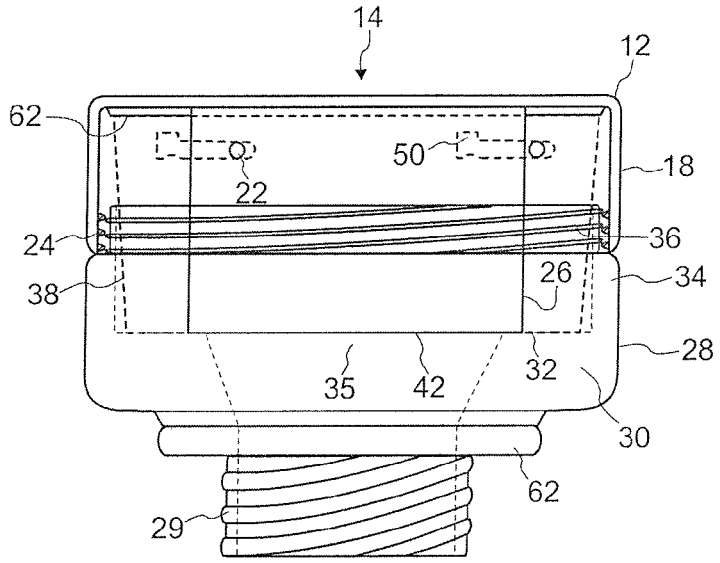
FIG. 8 is a side view of the lid, the telescoping funnel (shown in phantom lines), and the base of the cap assembly of FIG. 1 when the cap assembly is in a closed position and the protrusions of the lid are engaging the slots of the funnel. A center protrusion of the lid is shown contacting an inner surface of the bottom portion of the telescoping funnel.
Figure 9:
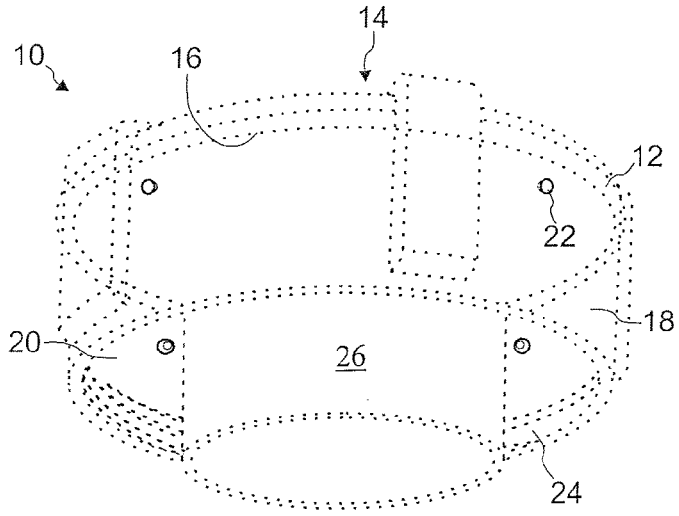
FIG. 9 is a bottom perspective view of the lid (shown in phantom lines) of the cap assembly of FIG. 1 having four protrusions on an inner surface of its annular side wall. The protrusions are shown positioned above the threading.

Referring now to FIGS. 6-8, the cap assembly 10 is shown in a closed position. When in a closed position, the protrusions 22 on the inner surface 20 of the annular side wall 18 of the lid 12 are gripped by the narrow ends 56 of the slots 50 on the top portion 40 of the telescoping funnel 38 (see FIG. 8). FIG. 8 also shows that the center protrusion 26 of the lid 12 is dimensioned to contact an inner surface 44 of the bottom portion 42 of the telescoping funnel 38 when the cap assembly 10 is in a closed position. This helps to prevent any vibration and potential detachment of the bottom portion 42 of the telescoping funnel 38 from the inner surface 32 of the bottom portion 30 of the base 28. This would prove to be helpful if the cap assembly 10 was used in the engine of a vehicle or other mode of transportation. Further preferably, the bottom portion 42 of the telescoping funnel 38 has a diameter larger than that of the aperture 35 defined by the bottom portion 30 of the base 28 in order to prevent the bottom portion 42 of the telescoping funnel 38 from ever falling into the liquid container (see FIG. 7).

The cap assembly 10 is shown as having rubber seals 62 coupled to both the bottom portion 42 of the base 28 (see FIGS. 5-8) and to the inner surface 16 of the top portion 14 of the lid 12 (see FIGS. 4, 6, 7, and 8). These rubber seals 62 help to avoid leaks. It should be clearly understood, however, that substantial benefit may nevertheless be derived from a cap assembly 10 with rubber seals 62 on either the bottom portion 42 of the base 28 or the inner surface 16 of the top portion 14 of the lid 12, and from a cap assembly 10 having no rubber seals 62.

Statement of Operation

When using the present invention, a user will twist the lid 12 in a first direction (e.g. counter-clockwise) to disengage the threading 24 of the inner surface 20 of the annular side wall 18 of the lid 12 from the threading 36 of the annular side wall 34 of the base 28. The user will then pull upwardly on the lid 12 to extend the telescoping funnel 38 that is stored within the cap assembly 10. The user will then twist the lid 12 in a second direction (e.g. clockwise) that is preferably opposite from the first direction in order to disengage the protrusions 22 from the slots 50. Once the lid 12 is removed, the user may pour liquid into (or remove liquid from) the top portion 40 of the telescoping funnel 38.

When finished, the user may place the lid 12 onto the top portion 40 of the telescoping funnel 38 so that the protrusions 22 are inserted into the wide ends 52 of the slots 50. The user will then twist the lid 12 in the first direction (e.g. counter-clockwise) so that the protrusions 22 slide along the middle portions 54 of the slots 50 until the protrusions 22 are gripped by the narrow ends 56 of the slots 50. Then, the user will push down onto the lid 12 to collapse the telescoping funnel 38 and will twist the lid 12 in the second direction (e.g. clockwise) to mate the threading 24 coupled to the inner surface 20 of the annular side wall 18 of the lid 12 to the threading 36 coupled to the annular side wall 34 of the base 28.

While the invention has been particularly shown and described with reference to preferred embodiments thereof, it will be understood by those skilled in the art that the foregoing and other changes in form and details may be made therein without departing from the spirit and scope of the invention. For example, the cap assembly 10 of the present invention may be used with any liquid container, not just those used in the engine of a vehicle.

I claim:

1. A method for adding liquid to a liquid container of an engine:

providing a cap assembly for a liquid container comprising;

a base dimensioned to be coupled to an opening of a liquid container, said base having a bottom portion and an annular side wall coupled to said bottom portion;

a lid having a top portion and an annular side wall coupled to said top portion;

threading coupled to an inner surface of said annular side wall of said base;

threading coupled to an inner surface of said annular side wall of said lid and dimensioned to removably mate with said threading coupled to said annular side wall of said base;

a telescoping funnel, a bottom portion of said telescoping funnel coupled to an inner surface of said bottom portion of said base;

at least one slot defined by a top portion of said telescoping funnel; and at least one protrusion coupled to an inner surface of said annular side wall of said top, said at least one protrusion dimensioned to engage said at least one slot so that said lid being detachably coupled to said telescoping funnel;

twisting said lid in a first direction to disengage said threading of said inner surface of said annular side wall of said lid from said threading of said annular side wall of said base;

pulling upwardly on said lid to extend said telescoping funnel;

twisting said lid in a second direction, said second direction being opposite from said first direction, to disengage said at least one protrusion from said at least one slot; and pouring liquid into said top portion of said telescoping funnel.

2. The method of claim 1 further comprising the steps of:

placing said lid onto said top portion of said telescoping funnel so that said at least one protrusion is inserted into said at least one slot;

twisting said lid in said first direction so that said at least one protrusion is tightly gripped by said at least one slot;

pushing down onto said lid to collapse said telescoping funnel;

twisting said lid in said second direction to mate said threading coupled to said inner surface of said annular side wall of said lid to said threading coupled to said annular side wall of said base.

3. The method of claim 1 wherein said at least one slot of said top portion of said telescoping funnel of said cap assembly having:

a wide end larger than said at least one protrusion and dimensioned to receive said at least one protrusion;

a tapered middle portion; and a narrow end dimensioned to grip said at least one protrusion.

4. The method of claim 1 wherein said bottom portion of said telescoping funnel being integral to said inner surface of said bottom portion of said base.

5. The method of claim 1 wherein said cap assembly further comprises at least one rubber seal coupled to at least one of said bottom portion of said base and an inner surface of said top portion of said top.

* * * * *